US008957267B2

(12) United States Patent
Feugnet et al.

(10) Patent No.: US 8,957,267 B2
(45) Date of Patent: Feb. 17, 2015

(54) DEVICE FOR CONTROLLING THE OPERATING CONDITIONS IN A CATALYTIC CRACKING UNIT WITH TWO RISERS

(75) Inventors: Frederic Feugnet, Lyons (FR); Thierry Gauthier, Brignais (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 323 days.

(21) Appl. No.: 12/999,534

(22) PCT Filed: Jun. 3, 2009

(86) PCT No.: PCT/FR2009/000639

§ 371 (c)(1),
(2), (4) Date: Apr. 1, 2011

(87) PCT Pub. No.: WO2009/153441

PCT Pub. Date: Dec. 23, 2009

(65) Prior Publication Data

US 2011/0178347 A1 Jul. 21, 2011

(30) Foreign Application Priority Data

Jun. 17, 2008 (FR) ..... 08 03384

(51) Int. Cl.
*C07C 4/06* (2006.01)
*C10G 47/00* (2006.01)
(Continued)

(52) U.S. Cl.
CPC ..... *C10G 11/18* (2013.01); *C10G 11/05* (2013.01); *C10G 11/182* (2013.01); *C10G 11/187* (2013.01); *C10G 51/026* (2013.01); *C10G 2300/4006* (2013.01); *C10G 2400/02* (2013.01); *C10G 2400/20* (2013.01)
USPC ..... 585/303; 585/300; 585/310; 585/648; 585/653

(58) Field of Classification Search
USPC ..... 585/14, 648
See application file for complete search history.

(56) References Cited

U.S. PATENT DOCUMENTS 3,563,911 A * 2/1971 Pfeiffer et al. ..... 502/43
4,064,039 A 12/1977 Penick
(Continued)

FOREIGN PATENT DOCUMENTS

EP 0892031 A2 9/1997
WO 0144409 A1 6/2001

OTHER PUBLICATIONS

World IP Organization. "International Search Report." PCT/FR2009/000639, Applicant: IFP, Mailed: Dec. 23, 2009.
(Continued)

*Primary Examiner* — In Suk Bullock
*Assistant Examiner* — Youngsul Jeong
(74) *Attorney, Agent, or Firm* — Millen, White, Zelano & Branigan, P.C.

(57) ABSTRACT

The invention concerns a process for the production of gasoline and for the co-production of propylene using a catalytic cracking unit comprising a catalyst regeneration zone and a reaction zone with two risers functioning in parallel under different severity conditions, the catalyst circulating between the regeneration zone and the reaction zone in two parallel circuits, a circuit termed the principal circuit comprising a first external catalyst cooling system, and a circuit termed the secondary circuit comprising a second external catalyst cooling system.

12 Claims, 1 Drawing Sheet

(51) Int. Cl.

| | |
|---|---|
| ***C10G 11/18*** | (2006.01) |
| ***C10G 11/05*** | (2006.01) |
| ***C10G 51/02*** | (2006.01) |

(56) References Cited

U.S. PATENT DOCUMENTS

| | | | | |
|---|---|---|---|---|
| 4,584,090 | A | 4/1986 | Farnsworth | |
| 4,591,425 | A | 5/1986 | Kovach et al. | |
| 4,875,994 | A | 10/1989 | Haddad et al. | |
| 5,009,769 | A | 4/1991 | Goelzer | |
| 6,656,346 | B2 * | 12/2003 | Ino et al. | 208/120.01 |
| 7,566,811 | B2 * | 7/2009 | Louret et al. | 585/653 |
| 2004/0064007 | A1 * | 4/2004 | Beech et al. | 585/639 |
| 2010/0286459 | A1 * | 11/2010 | Gauthier et al. | 585/303 |

OTHER PUBLICATIONS

World IP Organization. "Written Opinion." PCT/FR2009/000639, Applicant: IFP, Mailed: Dec. 23, 2009.

* cited by examiner

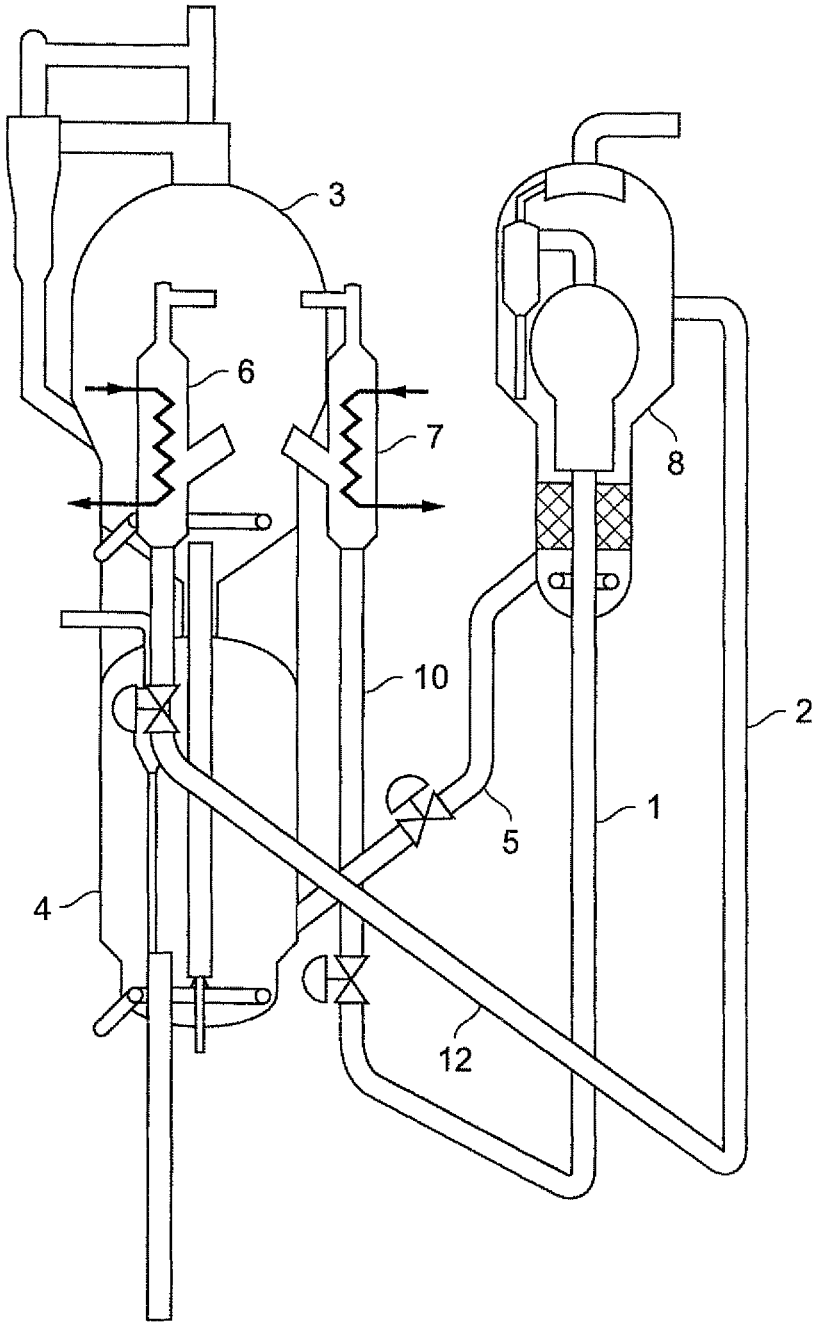
3
6
7
8
10
2
1
5
4
12

DEVICE FOR CONTROLLING THE OPERATING CONDITIONS IN A CATALYTIC CRACKING UNIT WITH TWO RISERS

FIELD OF THE INVENTION

The present invention relates to the field of catalytic cracking of oil cuts, more particularly cuts termed heavy cuts.

The principal feed for FCC (fluidized bed catalytic cracking) of heavy cuts is generally a hydrocarbon or a mixture of hydrocarbons essentially (i.e. at least 80%) containing molecules with a boiling point of more than 340° C. This feed contains limited quantities of metals (Ni+V), generally less than 50 ppm, preferably less than 20 ppm, and a hydrogen content which is generally more than 11% by weight, typically in the range 11.5% to 14.5% and preferably in the range 11.8% to 13%. It is also preferable to limit the nitrogen content to below 0.5% by weight.

The Conradson Carbon Residue (abbreviated to CCR) in the feed (defined by standard ASTM D 482) has a major impact on the dimensioning of the unit in order to satisfy the thermal balance. Depending on the Conradson Carbon Residue of the feed, the coke yield requires the dimensioning of the unit to be specific in order to satisfy the thermal balance.

These heavy cuts may in particular derive from atmospheric distillation, from vacuum distillation, from a hydrocracking unit or from deasphalting.

The catalytic cracking unit of a refinery is intended for the production of bases for gasoline, i.e. cuts with a distillation range in the range 35° C. to 250° C. More and more often, this prime objective is accompanied by a new objective, namely the co-production of light olefins, essentially ethylene and propylene.

The production of gasoline is assured by cracking heavy feed in the principal reactor (termed the principal riser in the remainder of the text because of the rising flow of the catalyst and the longilinear form of the reactor, following the terminology of the skilled person).

The co-production of propylene is generally obtained by recycling to an additional reactor, termed the additional riser, of a portion of the gasoline cut produce by the catalytic cracking unit or from an equivalent feed such as C5, C6, C7 or C8 oligomers.

In the remainder of the text, the term "principal riser" (1) will be used to designate the riser orientated towards the production of gasoline, and the term "secondary riser" (2) will be used to designate the riser dedicated to the production of propylene.

The co-production of propylene necessitates a major modification to the operating conditions of the secondary riser compared with the operating conditions of the principal riser.

The optimized propylene production conditions in the secondary riser are obtained for riser outlet temperatures in the range 550° C. to 650° C., and preferably in the range 580° C. to 610° C., contact times in the range 20 to 500 ms, preferably in the range 50 ms to 200 ms (ms=millisecond) and flows of solid in the range 150 to 600 kg/s/m$^2$, the contact time being defined as the ratio of the volume of catalyst present in the reactor with respect to the volumetric flow rate of the fluid passing through the reactor under the reaction operating conditions.

These conditions mean that the secondary riser is operated at catalyst to feed ratios (denoted C/O) in the range 10 to 35, preferably in the range 14 to 25. Typically, a traditional riser operating under gasoline production conditions functions with a catalyst to feed ratio in the range 4 to 15, preferably in the range 5 to 10, and with riser outlet temperatures (denoted TS) in the range 510° C. to 580° C., preferably in the range 520° C. to 570° C.

The increase in the C/O ratio and the increase in the outlet temperature TS will collectively be referred to as more severe operating conditions.

Thus, the secondary riser functions under operating conditions which are substantially more severe than the principal riser.

The two risers are supplied with regenerated catalyst the temperature of which results from the combustion of coke. For a desired cracking temperature, the quantity of catalyst circulating in the unit thus depends on the regeneration temperature. A change in the operation of the first riser could thus modify the regeneration temperature and directly affect the function of the second riser.

The present invention allows independent and optimized control of the functional conditions of each riser by means of an independent control of the catalyst inlet temperatures in the two risers.

In the remainder of the text, the term "cat cooler" will be used to denote the heat exchanger external to the regeneration zone which can cool the catalyst removed from a point in said zone and re-introduced after cooling to another point in the regeneration zone.

The cat cooler or cat coolers used in the present invention differ from a prior art cat cooler in that it (they) have at least one specific outlet which returns the cooled catalyst directly to one of the risers.

EXAMINATION OF THE PRIOR ART

The prior art concerning catalytic cracking units with two risers, one conventional for the production of gasoline, the other operating under more severe conditions to produce light olefins, has been described in patent FR-07/04 672.

This application does not describe means for achieving independent and optimized control of the temperature of each of the risers.

The aim of the present invention is to describe means which can effectively be used to adjust the temperature of the catalyst at the inlet to each riser in order to simultaneously optimize the gasoline production in the principal riser and the co-production of propylene in the secondary riser.

BRIEF DESCRIPTION OF THE FIGURES

FIG. 1 shows a layout of a catalytic cracking unit of the invention with two risers and two cat coolers, each riser being supplied with catalyst derived directly from the dedicated cat cooler of the corresponding riser.

BRIEF DESCRIPTION OF THE INVENTION

The invention thus consists in a process for producing gasoline and for co-producing propylene using a novel configuration of the catalytic cracking unit, allowing independent control of the temperature and contact time conditions in the principal riser supplied with a conventional feed dedicated to the production of gasoline and operating under moderate severity conditions and in the secondary riser supplied with a gasoline or equivalent cut, dedicated to the production of propylene and operating under high severity conditions.

FIG. 1 shows a diagram of a preferred implementation of the invention.

The principal riser 1 is supplied with catalyst deriving from the regeneration zone which has been cooled in a cat cooler 7, termed the principal cat cooler, and sent directly from the outlet from said cat cooler to the base of the principal riser 1 via the transfer line 10.

The circuit for the catalyst passing via the regeneration zone, the cat cooler 7, the transfer line 10 and the principal riser 1 is termed the principal circuit.

The secondary riser 2 is supplied with catalyst deriving from the regeneration zone which has been cooled in a cat cooler 6, termed the secondary cat cooler 6, which is distinct from the principal cat cooler 7, and sent directly from the outlet from said secondary cat cooler to the base of the secondary riser 2 via the transfer line 12.

The circuit for the catalyst passing via the regeneration zone, the cat cooler 6, the transfer line 12 and the secondary riser 2 is termed the secondary circuit.

The existence of two distinct cat coolers, thus including different exchange surfaces, supplied from the same catalyst removed from the regeneration zone, means that a fraction of catalyst cooled under optimized conditions can be delivered to the principal riser 1 and a fraction of catalyst cooled under optimized conditions can be supplied to the secondary riser 2. The fact that a cat cooler is disposed on each of the catalyst circuits means that the temperature of the catalyst sent to each riser can be controlled independently and thus the function of each of the risers can be optimized independently.

The principal riser 1 is optimized to operate under medium severity conditions and the secondary riser 2 is optimized to operate under high severity conditions.

Further, sending the catalyst leaving each cat cooler (principal or secondary) directly to the corresponding riser (principal or secondary respectively) is accompanied by a non-negligible energy saving which has been calculated to be about 10% of the total heat exchanged by each of the cat coolers compared with a single cat cooler providing internal cooling at the regeneration zone, i.e. with one outlet for cooled catalyst inside the regeneration zone. This saving is explained by the fact that in the configuration of the present invention, the combustion air is not cooled, in contrast to a traditional arrangement.

The present invention is compatible with any type of configuration of the regeneration zone, whether that zone has one stage or two stages operating in series.

Thus, it may be applied to remodeling existing units without having to modify the regeneration zone in which air burns the coke formed during the reaction.

More precisely, the present invention can thus be defined as a fluidized bed catalytic cracking unit comprising two independent circuits for catalyst the temperature of which is controlled in a separate manner:

- a first circuit, termed the "principal" circuit, comprising a principal riser operating under moderate severity conditions and comprising a catalyst cooling system (principal cat cooler) placed between the regeneration zone and the reaction zone;
- a second circuit, termed the "secondary" circuit, comprising a secondary riser operating under high severity conditions and comprising a catalyst cooling system (secondary cat cooler) placed between the regeneration zone and the reaction zone.

The secondary riser operates with a contact time in the range 50 to 200 ms, and with a catalyst flow rate in the range 150 $kg/m^2 \cdot s$ to 600 $kg/m^2 \cdot s$ (ms is the abbreviation for millisecond, i.e. $10^{-3}$ second).

It is also possible to implement the invention using another means for independently controlling not only each inlet temperature of the riser independently, but the difference in the two inlet temperatures in each of the risers.

In this case, the catalyst supplying the principal riser 1 is cooled with a single cat cooler having two distinct outlets for cooled catalyst, a first outlet to the regeneration zone and a second outlet to the secondary riser using a specific line.

The catalyst for the principal riser 1 is supplied from a point for removing said catalyst located in the regeneration zone.

The heat in the secondary riser 2 is controlled by mixing a portion of the catalyst leaving the regeneration zone with another portion of catalyst directly leaving the cat cooler via the specific line.

This is the reason why the cat cooler in this variation has two distinct outlets for catalyst, one which returns the cooled catalyst to a point in the regeneration zone, the other which sends the cooled catalyst to the secondary riser 2 via the specific line.

Adjusting the ratio of the two streams of catalyst can produce the desired conditions in the secondary riser. In this case, the temperature of the catalyst sent to the principal riser is influenced by that of the secondary riser. In this configuration, the difference in temperature between the catalysts sent to each riser is controlled. The optimized conditions for each riser are thus provided by the design adapted for a single cat cooler.

DETAILED DESCRIPTION OF THE INVENTION

The description below will be better understood with the assistance of the accompanying FIG. 1 which corresponds to the basic case of the present invention.

The catalytic cracking unit of the invention has a first riser, termed the principal riser 1, processing a conventional vacuum distillate or residue which may or may not have been hydrotreated and a second riser, termed the secondary riser 2, processing a light feed for the production of olefins. This light feed may be constituted by a gasoline cut, in particular a portion of the gasoline produced by the cracking unit itself, which is thus recycled to the base of the secondary riser 2, or by any cut the distillation range of which is in the range 35° C. to 250° C., such as C5, C6, C7 and C8 oligomers.

The principal riser 1 operates under conventional cracking conditions which may be summarized as follows:

- C/O ratio in the range 4 to 15, such as 6 to 14 or 7 to 12, preferably in the range 5 to 10;
- Temperature at riser outlet in the range 510° C. to 580° C., preferably in the range 520° C. to 570° C.

The secondary riser 2 operates under more severe conditions which can be summarized as follows:

- Contact time in the range 20 to 500 ms, preferably in the range 50 to 200 ms;
- C/O ratio in the range 10 to 35, preferably in the range 14 to 25;
- Riser outlet temperature in the range 550° C. to 650° C., preferably in the range 580° C. to 610° C.;
- Catalyst flow rate in the range 150 to 600 $kg/m^2 \cdot s$.

The severity conditions for each riser are produced by dint of a specific cooling system for each riser, termed a principal cat cooler 10 for the principal riser 1 and a secondary cat cooler 12 for the secondary riser 2.

The term "cat cooler" means an exchanger external to the regeneration zone operating as a fluidized bed and which can cool the catalyst removed from the regeneration zone before re-introducing it into the reaction zone via a line bringing the cooled catalyst leaving the cat cooler to the base of the riser. This transfer line is denoted 10 to supply the principal riser 1 and denoted 12 to supply the secondary riser 2.

When the regeneration zone comprises two stages (denoted 4 for the first stage and 3 for the second stage in FIG. 1), the catalyst is generally removed from the second stage at a temperature in the range 715° C. to 800° C., preferably close to 750° C. When the regeneration zone comprises just one stage, the catalyst is removed from said stage at a temperature in the range 650° C. to 780° C., preferably close to 750° C.

Gas-solid separation in the reaction zone may be carried out using any system which is known to the skilled person, such as those described in patent application FR-06/10982.

The catalyst recovered after the gas-solid separation system is sent to a stripping zone 8 then to the regeneration zone via a line termed a stand pipe 5 in which the catalyst circulates at a density in the range 450 to 600 kg/m$^3$.

The catalytic system employed for this invention contains at least one base zeolite which is normally dispersed in a suitable matrix such as alumina, silica, silica-alumina, for example, to which at least one zeolite with form selectivity may be added.

The most frequently used base zeolite is Y zeolite, but advantageously, another zeolite may be used, alone or as a mixture with Y zeolite.

The catalyst in the process of the invention may in particular comprise at least one zeolite with form selectivity, said zeolite comprising silicon and at least one element selected from the group constituted by aluminium, iron, gallium, phosphorus, boron and, preferably, aluminium.

The zeolite with form selectivity may be one of the following structure types: MEL (for example ZSM-11), MFI (for example ZSM-5), NES, EUO, FER, CHA.

The proportion of zeolite with form selectivity with respect to the total quantity of zeolite may vary as a function of the feeds used and the desired product range. In the present invention, 2% to 60%, preferably 3% to 40% and more preferably 3% to 30% by weight of zeolite(s) with form selectivity is used.

EXAMPLE

In order to illustrate the present invention, three examples will be used, denoted 1, 2 and 3.

Examples 1 and 2 pertain to the prior art; Example 3 is in accordance with the invention.

The feed for the principal riser was a hydrotreated atmospheric residue with the following properties:

H2 content=12% by weight;

Conradson Carbon (CCR)=5.7%;

Ni+V content=21 ppm

Density=0.935

The catalyst was a Y zeolite supplemented with 10% by weight of ZSM-5.

The light cut recycled to the secondary riser was a C6+−220° C. cut from the principal heavy feed conversion riser, with 50% of the total gasoline produced being recycled to the two-riser cracking unit.

Example 1

This example illustrates the case of a catalytic cracking unit with 2 risers and 1 cat cooler and a 2-stage regeneration zone, riser 1 being optimized for the production of gasoline, and the non-optimized riser 2 being supplied with a portion of the catalytic gasoline derived from the principal riser.

| | |
|---|---|
| Flow rate of fresh feed, principal riser | 294 t/h |
| Flow rate of light feed recycled to secondary riser | 57 t/h |
| Temperature of fresh feed, principal riser | 200° C. |
| Temperature, light feed recycled to secondary riser | 70° C. |

-continued

| | |
|---|---|
| Temperature, principal riser outlet | 560° C. |
| Temperature, secondary riser outlet | 580° C. |
| Temperature, stage 1 regenerator | 671° C. |
| Temperature, stage 2 regenerator | 718° C. |
| Temperature of catalyst, principal riser inlet | 718° C. |
| Temperature of catalyst, secondary riser inlet | 718° C. |
| C/O ratio, principal riser | 8 |
| C/O ratio, secondary riser | 13 |
| Heat exchanged in cat cooler | 42000 Mcal/h |

The structure of the yields obtained is given in Table 1 below:

TABLE 1

| | |
|---|---|
| Dry gases (with $H_2S$) | 6.48 |
| C2= | 1.97 |
| C3= | 10.14 |
| LPG (C3t + C4t) | 28.90 |
| C5-220 | 32.82 |
| 220-360 | 12.49 |
| 360+ | 9.09 |
| Coke | 10.22 |

Example 2

This example illustrates the case of a catalytic cracking unit with 2 risers and 1 cat cooler and a 2-stage regeneration zone, riser 1 not having been optimized, and riser 2 optimized for the production of olefins.

| | |
|---|---|
| Flow rate of fresh feed, principal riser | 294 t/h |
| Flow rate of light feed recycled to secondary riser | 57 t/h |
| Temperature of fresh feed, principal riser | 200° C. |
| Temperature, light feed recycled to secondary riser | 70° C. |
| Temperature, principal riser outlet | 560° C. |
| Temperature, secondary riser outlet | 580° C. |
| Temperature, stage 1 regenerator | 620° C. |
| Temperature, stage 2 regenerator | 651° C. |
| Temperature of catalyst, principal riser inlet | 651° C. |
| Temperature of catalyst, secondary riser inlet | 651° C. |
| C/O ratio, principal riser | 14 |
| C/O ratio, secondary riser | 25 |
| Heat exchanged in cat cooler | 50500 Mcal/h |

This example shows that in the conventional case, the optimized conditions for each riser cannot be achieved simultaneously. Producing optimized C/O conditions for the secondary riser necessitates greater cooling between reg2 and reg1 via the cat cooler. This superfluous cooling resulted in too big a drop in the temperature of reg1 (620° C.) and reg2 (651° C.), which means that optimized conditions for regeneration could not be obtained since this was outside the preferred range. Further, optimization of the second riser destabilizes the principal riser which means that its C/O changed from 8 to 14.

The structure of the yields obtained is given in Table 2 below:

TABLE 2

| | |
|---|---|
| Dry gases (with H2S) | 8.19 |
| C2= | 2.60 |
| C3= | 11.92 |
| LPG (C3t + C4t) | 32.22 |
| C5-220 | 28.40 |

TABLE 2-continued

| | |
|---|---|
| 220-360 | 11.57 |
| 360+ | 9.04 |
| Coke | 10.58 |

While the yields of propylene, ethylene and LPG were much higher when the conditions of the secondary riser were rendered more severe, the high C/O of the principal riser led to a yield of excess dry gases of more than 8%, hence a loss in propylene to dry gas selectivity (1.45 as opposed to 1.56).

The reduction in this ratio derives from the fact that the propylene gain did not compensate for the associated increase in the dry gases. Dry gases cannot be upgraded and their production has to be minimized.

Finally, the loss of optimized conditions in the principal riser resulted in a large loss of yield of gasoline of 13.5% (28.4% as opposed to 32.82%).

Example 3

This example, in accordance with the invention, illustrates the case of a catalytic cracking unit with 2 risers, each having a dedicated cat cooler which allowed it to operate under optimized conditions.

| The 2-stage regeneration zone was the same as in Examples 1 and 2. | |
|---|---|
| Flow rate of fresh feed, principal riser | 294 t/h |
| Flow rate of light feed recycled to secondary riser | 57 t/h |
| Temperature of fresh feed, principal riser | 200° C. |
| Temperature, light feed recycled to secondary riser | 70° C. |
| Temperature, principal riser outlet | 560° C. |
| Temperature, secondary riser outlet | 580° C. |
| Temperature, stage 1 regenerator | 681° C. |
| Temperature, stage 2 regenerator | 732° C. |
| Temperature of catalyst, principal riser inlet | 718° C. |
| Temperature of catalyst, secondary riser inlet | 652° C. |
| C/O ratio, principal riser | 8 |
| C/O ratio, secondary riser | 25 |
| Heat exchanged in principal cat cooler | 9500 Mcal/h |
| Heat exchanged in secondary cat cooler | 32500 Mcal/h |

This case illustrates the invention in which the C/O of each riser can be adjusted independently.

A C/O of 25 was achieved for the principal riser and a C/O of 8 was maintained in the principal riser.

The temperatures of reg1 of 681° C. and reg2 of 732° C. were within the desired functional ranges and could ensure optimized regeneration of the catalyst.

Table 3 below compares the yields obtained with those of Example 1:

TABLE 3

| Case | Example 1 | Example 3 |
|---|---|---|
| Dry gases (with H2S) | 6.48 | 6.97 |
| C2= | 1.97 | 2.16 |
| C3= | 10.14 | 11.19 |
| LPG (C3t + C4t) | 28.90 | 30.77 |
| C5-220 | 32.82 | 30.12 |
| 220-360 | 12.49 | 12.40 |
| 360+ | 9.09 | 9.35 |
| Coke | 10.22 | 10.38 |

An increase of 1.05 points in propylene (i.e. an increase of more than 10%) and 1.9 points in LPG (i.e. an increase of more than 6%) can be seen, which is highly significant given the tonnages involved.

Based on a processed feed flow rate of 294 t/h, this gain resulted in a supplemental propylene production over the basic case (Example 1) of 3.09 t/h.

The C3=/dry gas selectivity was retained or even improved with a ratio of 1.60 as opposed to 1.56 for the conventional case. The increase in dry gas in the 3 cases was thus compensated for by the associated gain in propylene.

The gasoline yield, although lower because of its conversion into LPG, remains within the desired range.

The invention claimed is:

1. A process for producing gasoline and for the co-production of propylene in a catalytic cracking unit comprising a one- or two-stage catalyst regeneration zone and a reaction zone having two risers, one termed the principal riser, the other termed the secondary riser, said process comprising operating the risers in parallel under different severity conditions, with a catalyst to feed ratio (C/O ratio) of the principal riser being in the range of 7 to 12, and a catalyst to feed ratio (C/O ratio) of the secondary riser being in the range of 14 to 25, the principal riser outlet temperature being in the range of 520° C. to 570° C., the secondary riser outlet temperature being in the range of 580° C. to 610° C., and a contact time in the secondary riser being in the range of 50 to 500 ms with a solids flow rate in the range of 150 to 600 kg/s·m$^2$, the principal riser being supplied by a feed having a hydrogen content in the range of 11.5% to 14.5% by weight, and the secondary riser being supplied by a gasoline cut comprising C5, C6, C7 and C8 oligomers wherein the feed to the secondary riser is, at least in part, a portion of the gasoline produced by the catalytic cracking unit, circulating the catalyst between the catalyst regeneration zone and the reaction zone in two parallel circuits, a circuit termed the principal circuit comprising the principal riser and a first external catalyst cooling system termed the principal cat cooler and a circuit termed the secondary circuit comprising the secondary riser and a second external catalyst cooling system termed the secondary cat cooler, the first external catalyst cooling system being supplied with catalyst removed from the catalyst regeneration zone and delivering the resultant cooled catalyst directly to the base of the principal riser, and the second external catalyst cooling system being supplied with catalyst removed from the regeneration zone and delivering resultant cooled catalyst directly to the base of the secondary riser.

2. A process for producing gasoline and for co-producing propylene according to claim 1, wherein the catalyst comprises a zeolite with form selectivity, said zeolite being selected from MEL, NES, EUO, FER, and CHA.

3. A process for producing gasoline and for co-producing propylene using a catalytic cracking unit as claimed in claim 1, in which the proportion of zeolite with form selectivity with respect to the total quantity of zeolite is from 2% to 60%.

4. A process according to claim 3, wherein the total quantity of zeolite with form selectivity with respect to the total quantity of zeolite is 3% to 40%.

5. A process according to claim 4, wherein the total quantity of zeolite with form selectivity with respect to the total quantity of zeolite is 3% to 30%.

6. A process according to claim 1, wherein the hydrogen content is in the range of 11.8% to 13%.

7. A process for producing gasoline and for co-producing propylene according to claim 1, wherein the contact time in the secondary riser being in the range of 50 to 200 ms.

8. A process for producing gasoline and for co-producing propylene according to claim 1, wherein said catalyst regeneration zone is a one-stage catalyst regeneration zone.

9. A process for producing gasoline and for co-producing propylene according to claim 1, wherein said catalyst regeneration zone is a two-stage catalyst regeneration zone.

10. A process for producing gasoline and for co-producing propylene according to claim 1, wherein the catalyst comprises at least one zeolite with form selectivity, said zeolite with form selectivity comprises silicon and at least one element selected from aluminum, iron, gallium, phosphorus, and boron.

11. A process for producing gasoline and for co-producing propylene according to claim 10, wherein said zeolite with form selectivity comprises silicon and aluminum.

12. A process for producing gasoline and for co-producing propylene according to claim 1, wherein catalyst discharged from both said primary riser and said secondary riser is introduced into a single stripping zone, and then catalyst from said stripping zone is sent to said regeneration zone via a standpipe.

* * * * *